US008889064B2

(12) United States Patent
Raisson

(10) Patent No.: US 8,889,064 B2
(45) Date of Patent: Nov. 18, 2014

(54) METHOD FOR PREPARING A NICKEL SUPERALLOY PART, AND THE PART THUS OBTAINED

(75) Inventor: Gérard Raisson, Cournon D'auvergne (FR)

(73) Assignee: Aubert & Duval, Paris (FR)

( * ) Notice: Subject to any disclaimer, the term of this patent is extended or adjusted under 35 U.S.C. 154(b) by 421 days.

(21) Appl. No.: 13/060,047

(22) PCT Filed: Aug. 24, 2009

(86) PCT No.: PCT/FR2009/051624

§ 371 (c)(1),
(2), (4) Date: Feb. 21, 2011

(87) PCT Pub. No.: WO2010/023405

PCT Pub. Date: Mar. 4, 2010

(65) Prior Publication Data

US 2011/0150693 A1 Jun. 23, 2011

Related U.S. Application Data

(60) Provisional application No. 61/091,926, filed on Aug. 26, 2008.

(30) Foreign Application Priority Data

Aug. 26, 2008 (FR) ..... 08 55716

(51) Int. Cl.
*B22F 3/24* (2006.01)

(52) U.S. Cl.
USPC ..... 419/28; 75/245

(58) Field of Classification Search
USPC ..... 419/29, 28; 75/245
IPC .... B22F 3/15,2998/10, 3/17; C22F 1/10; C22C 1/0433

See application file for complete search history.

(56) References Cited

U.S. PATENT DOCUMENTS 3,902,862 A 9/1975 Moll et al.
4,981,644 A 1/1991 Chang (Continued)

FOREIGN PATENT DOCUMENTS

EP 0 270 230 A2 6/1988
EP 0 438 338 A1 7/1991
EP 0 676 483 A1 10/1995

OTHER PUBLICATIONS

Raisson G: "Evolution of PM nickel base superalloy processes and products"; Powder Metallurgy Institute of Materials UK, Mar. 2008.

(Continued)

*Primary Examiner* — Weiping Zhu

(74) *Attorney, Agent, or Firm* — Rader, Fishman & Grauer PLLC

(57) ABSTRACT

A method for preparing a part in nickel-based superalloy is disclosed. The method comprises the following steps:

elaborating a nickel-based superalloy with a composition capable of providing hardening by double precipitation of a gamma' phase and of a gamma" or delta phase;

atomizing a melt of the superalloy in order to obtain a powder;

sifting the powder;

introducing the powder into a container;

closing and applying vacuum to the container;

densifiying the powder and the container in order to obtain an ingot or a billet;

hot forming said ingot or said billet;

wherein before the densification step, the powder and the container are heated for at least 4 hrs, at a temperature both above 1,140° C. and at least 10° C. less than the solidus temperature of the superalloy, and at a pressure causing densification of less than or equal to 15% of the powder volume.

12 Claims, 2 Drawing Sheets

(56) References Cited

U.S. PATENT DOCUMENTS

| | | | | |
|---|---|---|---|---|
| 5,395,464 | A | 3/1995 | Davidson | |
| 2007/0020135 | A1* | 1/2007 | Jackson et al. | 419/29 |
| 2009/0142221 | A1* | 6/2009 | Strangman | 420/441 |

OTHER PUBLICATIONS

Rao, et al: "Influence of modified processing structure and properties of hot isostatically pressed superalloy Inconel 718"; Materials Science and Engineering A: A structural Materials: Properties, Microstructure & Processing, Lausanne, CH. (Feb. 25, 2006).

Appa Rao G., et al: "Effect of standard heat treatment on the microstructure and mechanical properties of hot isostatically pressed superalloy Inconel 718"; Materials Science & Engineering A (Structural Materials: Properties, Microstructure and Processing) Elsevier Switzerland. (Aug. 25, 2003).

Rao G. A., et al.: "Effect of oxygen content of powder on microstructure and mechanical properties of hot isostatically pressed superalloy Inconel 718"; Materials Science & Engineering A (Structural Materials: Properties, Microstructure and Processing) Elsevier, Switzerland. (Nov. 5, 2006).

PCT International Search Report for PCT/FR2009/051624 dated Jan. 26, 2010.

* cited by examiner

METHOD FOR PREPARING A NICKEL SUPERALLOY PART, AND THE PART THUS OBTAINED

CROSS-REFERENCE TO RELATED APPLICATIONS

This application is a National Phase of International Application PCT/FR/2009/051624, filed on Aug. 24, 2009, which claims priority to French Patent Application 08 55716 filed on Aug. 26, 2008, and U.S. Provisional Application 61/091,926 filed on Aug. 26, 2008, which applications are hereby incorporated by reference in their entirety.

TECHNICAL FIELD

The present disclosure relates to a method for obtaining forged parts from powders of a nickel superalloy hardened by double precipitation (gamma' and gamma" or delta), such as the superalloy with the commercial name of 725®.

BACKGROUND

Nickel superalloys are materials currently used for making components intended for aeronautical turbines, such as turbine discs. These materials are characterized by their capability of operating under strong stresses and under strong fatigue loads at high temperatures, beyond 650° C., which may attain 1,090° C. in the case of certain applications of aeronautical turbines. The search for high-performance materials capable of withstanding increasingly higher operating temperatures is related to the need of improving the thermodynamic yield of the turbines.

The components for aeronautical turbines in nickel-based superalloys (i.e. including at least 50% by weight of nickel, the remainder consisting of various alloy elements) are most conventionally obtained via a route for obtaining them, a so-called "ingot route" where the nickel-based superalloy is elaborated by melting and re-melting, and then cast and shaped as an ingot, before being hot-worked with thermomechanical and thermal treatment(s) in order to obtain the desired microstructure and final shape.

This ingot route is, however, not optimum for making parts having the aforementioned superior properties, because of a microstructure which is not sufficiently homogeneous after melting and re-melting the alloy. Indeed, a very homogeneous microstructure of the material before hot-working is required in order to be able to work the material with greater deformation levels and deformation rates, while avoiding the formation of clinics (i.e. surface cracks formed during cooling) during the thermomechanical treatment and the occurrence of structural defects in the material.

Already for a few years, the so-called "powder route" for obtaining parts (powder metallurgy) with which materials having a much more homogeneous structure may be obtained, has been developed for making high performance components in nickel-based superalloys, notably for applications to aeronautical turbines. This powder route notably includes the following steps:

- preparation of a melt having the targeted composition for the superalloy;
- atomization of the melt in order to obtain a powder;
- sifting this powder in order to only retain particles thereof having the desired grain size;
- introducing the powder into a container, which is closed and put under vacuum;

- densification of the powder and of the container in order to obtain an ingot or a billet of suitable dimensions;
- thermomechanical treatments (forging, for example) and optionally heat treatments of the ingot or of the billet in order to obtain a final part with dimensions and structures suitable for the targeted application.

However the parts obtained via the powder route are difficult to work by thermomechanical treatment, notably because of the lack of ductility of the parts obtained after densification of the powder.

The lack of ductility of the parts obtained from powders in nickel-based superalloys is explained by the characteristics of the surfaces of the original particles, which will mark the structure of the material and subsist after compacting the powder. The surfaces of the original particles are also known under the name of PPBs (Prior Particle Boundaries). The particles of the initial powder have surfaces which promote the formation and grouping of insoluble precipitates, such as oxides, sulfides, nitrides, sulfonitrides, carbides and/or carbonitrides which will subsist after compacting the powder. This phenomenon is known as "decorations" around the particles of powders. During the operation for compacting the powder, the precipitates present at the PPBs form stable lattices, the disappearance of which is not possible with subsequent treatments.

A consequence of this phenomenon is to promote interparticulate breakages during future stresses on the part, and to make it very difficult to enlarge the grain very substantially beyond the size of the original particles. Conventionally it is impossible to enlarge the grain beyond three times the sizes of the original particles. This makes the billet obtained after compacting of the powder very difficult to be forged and makes it impossible to obtain certain high final mechanical characteristics, such as good creep resistance.

In document EP-A-0 438 338 a solution was proposed with which the detrimental effects of the precipitates or decorations at the PPBs may be attenuated for nickel superalloys of the type with structural hardening by precipitation of the gamma' phase, such as notably the alloys known under the commercial names of ASTROLOY®, UDIMET 720® or N18®. This document specifies the typical compositions of the ASTROLOY® and N18® alloys. The typical composition of UDIMET 720® is:

15.5%≤Cr≤16.5%
14%≤Co≤15.5%
4.75%≤Ti≤5.25%
2.25%≤Al≤2.75%
2.75%≤Mo≤3.25%
1%≤W≤1.5%
0.025%≤Zr≤0.05%
0.01%≤C≤0.02%
0.01%≤B≤0.02%
Ni=the remainder This solution consists of carrying out pretreatment of the superalloy, before its densification, at a temperature below the solvus temperature or close to the solvus temperature, of the gamma' phase of the alloy (1,195° C. for ASTROLOY®, and 1,180° C. for N18®). With this method it is possible to attenuate the detrimental effect of the PPBs for superalloys hardened by gamma' phase precipitation, by precipitating the segregated elements inside the particles of powders and not at their surface. By this pretreatment, decoupled from densification strictly speaking, the grains may become larger beyond the size of the initial particles, which allows an improvement in the forgeability of the alloy.

However, it is found that this solution, although providing remarkable technological advantages for nickel-based alloys with structural hardening by simple precipitation of the gamma' phase, cannot be applied to nickel-based superalloys for which structural hardening is obtained by double precipitation of a gamma' phase and of a gamma" phase or delta phase.

Indeed, a pretreatment carried out under the solvus temperature of the gamma' phase or in the vicinity of this solvus temperature does not, in their case, allow suppression or attenuation of the detrimental effect of the PPBs and decorations at the PPBs.

Nickel-based superalloys hardened by double precipitation, because of their mechanical properties (mechanical strength, creep resistance and resistance to fatigue at high temperatures), would have a great benefit for aeronautical applications, notably for the components of turbines such as the discs or the vanes. It would therefore be very important to find an elaboration method, via the powder route, allowing the use of these superalloys for these applications, such as, for example, the known superalloy commercially designated as 725®, because of its mechanical properties and of its corrosion resistance.

SUMMARY

A method for preparing a part in a nickel-based superalloy by powder metallurgy is disclosed herein. The exemplary method includes the following:

- elaboration of a nickel-based superalloy with a composition capable of providing hardening by double precipitation of a gamma' phase and of a gamma" or delta phase;
- atomization of a melt of said superalloy in order to obtain a powder;
- sifting said powder in order to extract the particles thereof having a predetermined grain size;
- introducing the powder into a container, in one representative embodiment, by introducing the power under vacuum;
- closing and applying a vacuum to the container;
- densification of the powder and of the container by pressurization of the whole in order to obtain an ingot or a billet;
- hot shaping and in one exemplary arrangement, optionally heat treatmenting of said ingot or said billet;

wherein, before the step for densifying the powder and the container, a heat treatment step is performed that comprises heating the powder and the container for at least 4 hrs, and in one exemplary arrangement, for 12 to 30 hrs, at a pressure only causing densification of the powder of less than or equal to 15% of the initial volume, and in one exemplary arrangement, less than or equal to 10% of the initial volume, this treatment taking place at a temperature both above 1140° C. and at least 10° C. less than the solidus temperature of the superalloy.

The composition of the superalloy may be, in weight percentages:

19%≤Cr≤23%;
7%≤Mo≤9.5%;
2.75%≤Nb≤4%;
traces≤Fe≤9%;
traces≤Al≤0.6%;
1%≤Ti≤1.8%;
0.001%≤B≤0.005%;
traces≤Mn≤0.35%;
traces≤Si≤0.2%;
traces≤C≤0.03%;
traces≤Mg≤0.05%;
traces≤P≤0.015%;
traces≤S≤0.01%;
the remainder being nickel and impurities resulting from the elaboration.

In one exemplary arrangement, the heat treatment before densification may then be performed at a temperature 10 to 50° C. less than the solidus temperature of the superalloy.

For these alloys, the heat treatment before densification is carried out between 1,140° C. and 1,180° C.

For an alloy of the previous type, the heat treatment before densification is preferably carried out at a temperature both greater than 1,140° C. and 30 to 50° C. less than the solidus temperature of the superalloy.

The heat treatment before densification is in this case optimally carried out between 1,160 and 1,180° C. for 12 hours to 30 hours at a pressure of less than 50 bars.

In one exemplary arrangement, the densification may be carried out by hot isostatic compaction.

The hot shaping may include potting die forging.

A forged part constructed of a nickel-based superalloy is also disclosed, wherein the forged part is prepared by the method disclosed herein.

This part may be a component of an aeronautical or land gas turbine.

As this will have been understood, the disclosure comprises carrying out, on a powder of a superalloy capable of being hardened by double precipitation of a gamma' phase and of a gamma" or delta phase, a particular heat treatment of the powder and of its container before their densification, in a determined range of temperatures. This treatment has the purpose of dissociating the grain boundaries of the PPB lattices. The latter therefore in the following treatments can no longer oppose the growth of the grain boundaries, and finally more ductile structures are obtained, therefore more capable of being hot shaped such as by forging.

An exemplary alternative arrangement of the disclosure is directed to the superalloy called ARA 725® or 725®, the composition of which is the one cited above, and proposes a range of treatment temperatures before densification which is specially adapted to it.

BRIEF DESCRIPTION OF THE DRAWINGS

The disclosure will be better understood upon reading the description which follows, given with reference to the following appended figures.

DETAILED DESCRIPTION

Figure 1:
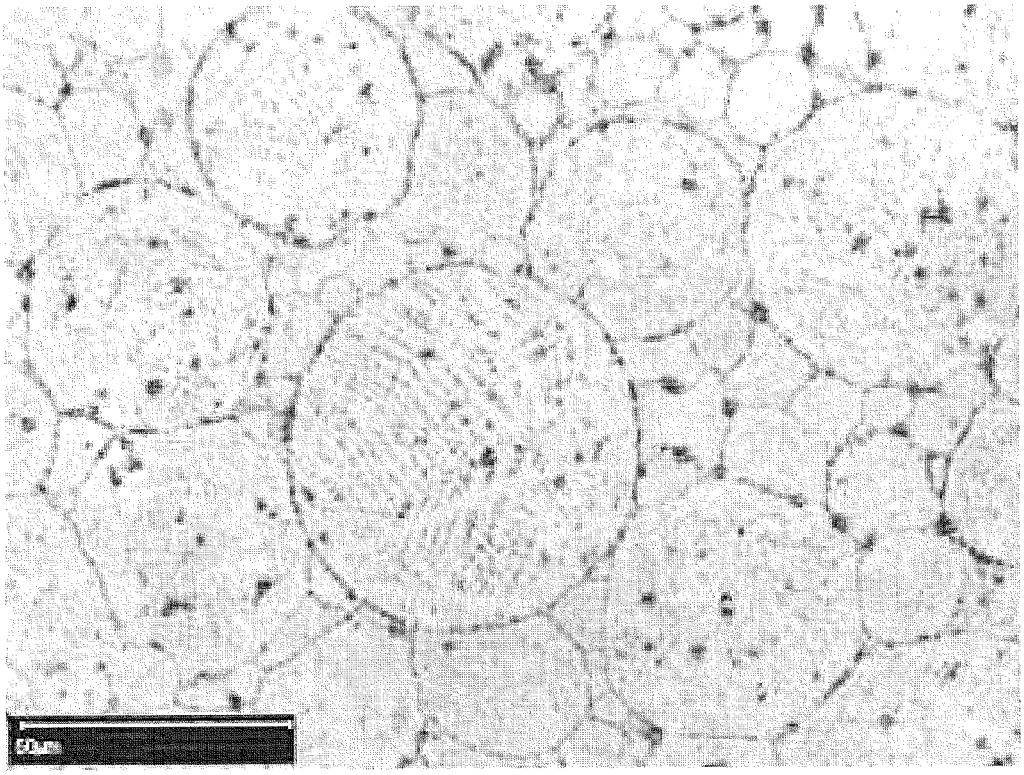
FIG. 1 shows a micrograph of an ingot obtained after HIC of an alloy powder 725® at 1,160° for 3 hours at 1,000 bars according to a conventional method.

The alloys ARA 725®, having the aforementioned compositions, have solidus temperatures of about 1,210° C., varying from 1,200 to 1,230° C. according to the specific composition.

In order to illustrate exemplary advantages of the disclosure with respect to treatments which would deviate from its specific conditions, the results of a series of experiments conducted on powder samples with two different compositions will be discussed. However, both compositions come under usual prescriptions relating to the alloy 725®, the solidus temperature of which is of about 1,210° C.±5° C. These compositions are shown in Table 1, expressed as weight %.

TABLE 1

Compositions of the tested samples

| Sample | Ni | Fe | Cr | Al | Ti | Mo | Nb | C | Co | Ta |
|---|---|---|---|---|---|---|---|---|---|---|
| 1 | remainder | 4.87 | 20.2 | 0.38 | 1.42 | 7.61 | 3.62 | 0.015 | <0.01 | <0.02 |
| 2 | remainder | 5.25 | 20.7 | 0.42 | 1.44 | 7.56 | 3.73 | 0.014 | 0.016 | <0.003 |

| Sample | B | Si | Mg | Mn | P | S | O | N |
|---|---|---|---|---|---|---|---|---|
| 1 | <0.0005 | 0.033 | <0.0005 | <0.03 | <0.0049 | <0.021 | 0.085 | 0.065 |
| 2 | 0.031 | 0.33 | <0.001 | 0.029 | <0.003 | 0.0017 | 0.0071 | 0.0106 |

Both of the tested samples essentially differ on their Fe contents, their contents of hardening elements Al, Ti, Nb and especially on their B contents, which are higher in sample 2.

First, the inventors of the exemplary methods disclosed therein, proceeded with a study of the phases likely to be present in the alloy 725®, for compositions coming under the disclosure or close to the latter. This study was conducted with the software package THERMOCALC, frequently used by metallurgists, on the one hand, and which gives the possibility of establishing phase diagrams of metal alloys, and on the other hand, by differential and heat analysis and dilatometric tests and by examinations under the optical microscope and the scanning electron microscope after different heat treatments.

The conclusions of this study is that 725® may in fact be hardened mainly by intergranular gamma" and delta phases which accompany the gamma" phase. The inventors therefore drew the conclusion that it is the obtaining of this intergranular gamma" or delta phase which should be preferred during treatments aiming at precipitating the hardening gamma' and gamma" phases before densification.

Experiments conducted on the samples 1 and 2 defined above included producing a slug with dimensions, diameter 70 mm and height 500 mm, by hot isostatic compaction (HIC) of the powder and of its container according to various methods which will be further specified below.

Powders of these alloys were first prepared and sifted in a standard way, having a grain size allowing them to pass through the meshes of a sieve of 100 μm.

In a first series of experiments, an HIC was carried out according to standard methods, i.e. simple isothermal maintenance for 3 hours between 1,000 and 1,400 bars, at temperatures of 1,025, 1,120 and 1,160° C., respectively.

In a second series of experiments, densification by HIC was preceded by heat treatment of the powder and of the container for 6 hours at 1,025, 1,120 and 1,160° C., respectively. Next the HIC took place at 1,000 bars for 3 hrs at the same temperature as the heat treatment. This cycle was called a "decoupled cycle". It will be seen that this decoupled cycle is in accordance with the disclosure when the temperature of the heat treatments is 1,160° C.

Micrographic observations and mechanical tests on the slugs resulting from these tests were then carried out in order to appreciate the effect of the undergone treatments on the morphology of the grains and of the grain boundaries, on the one hand, and the effect of these same treatments on the forgeability of the material on the other hand.

The micrographic observations were carried out under an optical microscope after electrolytic chemical etching.

The forgeability tests were conducted on specimens with a diameter of 6.35 mm and a length of 35 mm, which were deformed in traction at 1,025° C. at a low speed. The traction rate of the machine was minimum, 1.9 mm/s. The deformation rate of the sample was $5{\cdot}4{\cdot}10^{-2}$/s, therefore under conditions rather close to those targeted during typical die stamping of parts for which the elaborated alloy is intended.

The influences of the various treatments on the properties of the materials may be summarized as follows.

The microstructures obtained with the standard HIC cycles have a grain size which normally substantially increases with the temperature at which HIC is carried out. However, it is not possible under the chosen operating conditions to obtain a grain size having an ASTM index of less than 8, because of the presence of the PPBs at the grain boundaries, which limits the growth of the grains (it is recalled that the ASTM index indicating the size of the grains is all the higher since the size of the grains is small).

Figure 2:
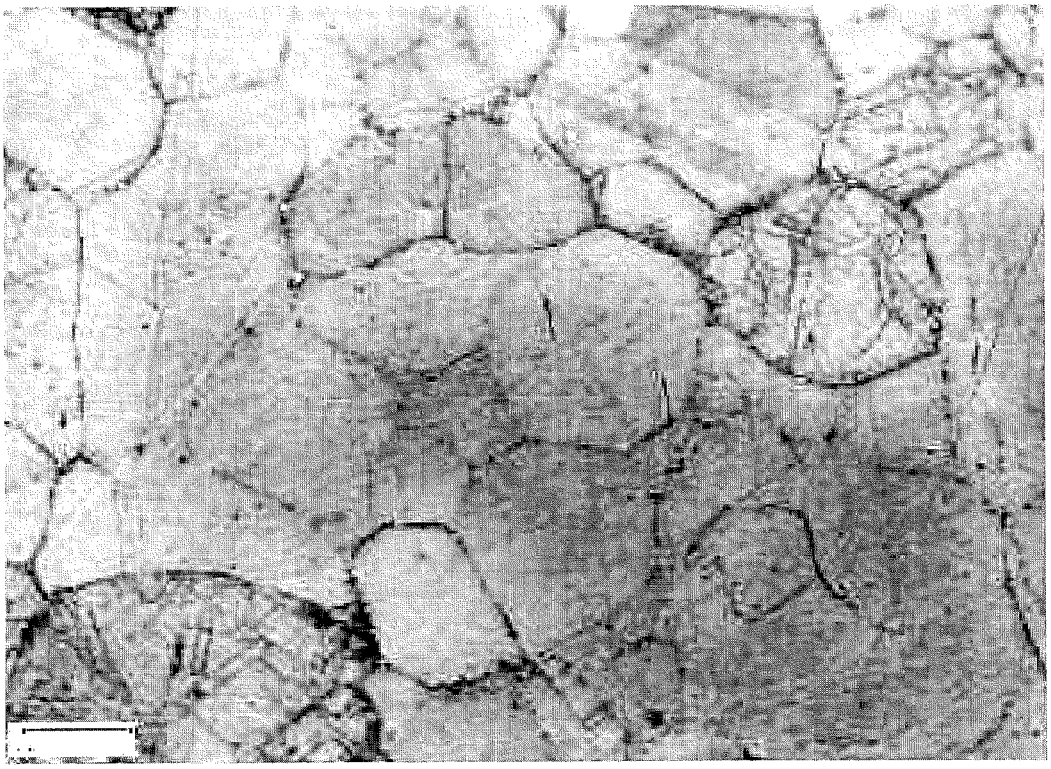
FIG. 2 which shows in the same way a micrograph of an ingot obtained according to an exemplary method of the disclosure from a powder of ARA 725® with the same composition as for FIG. 1, also obtained by HIC at 1,160° C. for 3 hours at 1,000 bars, but after the powder having undergone a heat treatment before densification at 1,160° C. for 6 hours at atmospheric pressure.

The decoupled cycles for which the preliminary heat treatment was carried out at 1,025 and 1,120° C. give the possibility of obtaining after HIC at the same temperature a product with a microstructure close to the one obtained after standard HIC cycles carried out at the same temperatures. On the other hand, a temperature of 1,160° C. allows an increase in the size of the grains to 6 or 7 ASTM, and partial decoupling is observed between the surfaces of the powder particles and the grain boundaries. This is what is shown by the comparison between FIGS. 1 and 2, which show the microstructures of two ingots made from the powder of sample 1:

one ingot (FIG. 1) by direct HIC of the powder at 1,160° C. for 3 hrs at 1,000 bars;

the other one (FIG. 2) by HIC carried out under the same conditions, but preceded. according to the disclosure, by a heat treatment of the powder and of its container, exposed to 1,160° C. for 6 hrs at atmospheric pressure.

It is clearly seen that on the ingot made according to the exemplary method of the disclosure, the size of the grains is clearly more homogeneous than for the reference, and the grains of very small size have disappeared, a sign that the PPBs did not form obstacles to their growth.

Table 2 shows the main results of the mechanical tests conducted on the different samples according to the undergone treatments. Rm is the tensile strength A is the elongation at break and Z is the striction of the specimen.

TABLE 2 results of the mechanical tests on the different samples.

| HIC Cycle | Samp. | Rm (MPa) | A (%) | Z (%) |
|---|---|---|---|---|
| Standard 1,025° C. | 1 | 159.5 | 5.4 | 2.3 |
| | 2 | 145 | 17 | 9 |

TABLE 2-continued results of the mechanical tests on the different samples.

| HIC Cycle | Samp. | Rm (MPa) | A (%) | Z (%) |
|---|---|---|---|---|
| Standard 1,120° C. | 2 | 123 | 12 | 7 |
| | 1 | 127 | 5 | 3 |
| Standard 1,160° C. | 1 | 143 | 13 | 6 |
| Decoupled 1,025° C. | 2 | 132 | 12.5 | 9 |
| Decoupled 1,120° C. | 2 | 131 | 16.5 | 12 |
| Decoupled 1,160° C. | 1 | 142 | 28 | 22.5 |
| | 2 | 149 | 26 | 21 |

The influence of the type of HIC cycle on forgeability may receive the following comments.

An improvement in the forgeability of the alloys in the standard HIC raw condition is observed when the temperature of the standard HIC cycle increases. Sample 1 has very poor ductility when HIC takes place at 1,025° C. (A=5.4%). With HIC at 1,160° C., the ductility of this alloy 1 is higher (A=13%). But between HICs at 1,025 and 1,120° C., the differences are not significant, which shows the small influence of the HIC temperature on forgeability in this range of temperatures, due to the similarity of the obtained microstructures.

With respect to the decoupled cycles, the improvement in the forgeability of alloy 1 is very clearly demonstrated for the 1,160° C. cycle. In this case a value of A of 28% is obtained. At lower temperatures, forgeability remains of the same order as the one for standard HIC cycles at an equivalent temperature. It is believed that this observation may be ascribed to the lack of clear decoupling between surfaces of the powder particles and of the grain boundaries for these temperatures.

The comparison between the results obtained on alloys 1 and 2 notably allows evaluation of the influence of boron on forgeability. It is particularly marked in the case when a standard HIC cycle at 1,025 and 1,120° C. is used, if one passes from a boron content as traces to a content of 30 ppm. But for the decoupled cycle at 1,160° C., the effect of boron is not significant.

Above all, the beneficial influence of the decoupled HIC cycle is also demonstrated on the damaging mode noticed after breakage of the samples. The low ductilities of the samples obtained with HIC cycles result in an intergranular breakage facies, substantially corresponding to the grains of the original powder. On the contrary, the decoupled HIC cycle according to the disclosure, provided it is performed at 1,160° C., provides samples with high ductility which have a transgranular breakage facies, by partial decoupling between the powder grains and the grain boundaries. With this decoupling, it is possible to partly delocalize the damage which normally occurs at the grain boundaries and it is a fundamental factor for improving the forgeability of the material.

Generally, the inventors were able to extrapolate these results, obtained on 725®, to the other nickel-based superalloys capable of being hardened by double precipitation of the gamma' and gamma" or delta phases. These known alloys of the IN706, IN718, IN725 types enter this category.

Their conclusions are that in order to be efficient on the forgeability of the material by causing decoupling between the grains of the initial powder and the grain boundaries of the product after densification of the powder and of its container, the heat treatment prior to densification should bring the powder for at least 4 hrs to a temperature above 1,140° C., and also 10° C. less or more than the solidus temperature of the superalloy, and in one exemplary arrangement, between 10 and 50° C. below the solidus, in order to cause substantial time-dependent changes in the PPBs without any risk of generating defects caused by local burning. In the case of 725® this may correspond to a temperature from 1,160 to 1,180° C., depending on the specific solidus temperature of the alloy, within the limits of the composition which are set by usual specifications, this temperature being maintained for 12 hrs to 30 hours. In one exemplary arrangement, the temperature is located between 30 and 50° C. below the solidus.

It is under these conditions that a sufficient modification of the PPBs is obtained which significantly reduces their capability of preventing the growth of the grain during the densification of the powder.

The duration of the heat treatment before densification may range up to 30 hrs depending on the dimensions of the part to be treated. Of course, one of the parameters to be considered for optimizing the treatment time is the size of the part to be made, the treatment time being all the higher since the part is thick so that the treatment may concern it homogeneously over the whole of its thickness. Optimally, this treatment time is from 15 to 17 hrs so that a treatment depth of 150 mm will most certainly be attained, corresponding to what is desirably achieved on components of aeronautical turbines of standard dimensions, to which the disclosure may be applied, though the disclosure is not exclusively directed to components of aeronautical turbines.

In one exemplary arrangement, the filling of the container with the powder is carried out under vacuum. Further, this application of vacuum is maintained during the actual densification step.

In one exemplary arrangement, the heat treatment before densification according to the disclosure is carried out in an inert atmosphere in order to avoid formation of carbon deposits on the container and oxides within the powder. The heat treatment may be carried out at atmospheric pressure or low pressure. The heat treatment should not cause densification of the powder, or only then a low densification of the powder of less than or equal to 15%, and in one exemplary arrangement, preferably less than or equal to 10% of the initial volume. The densification of the powder, or of at least a very major portion of this operation, should be achieved during the step which is specially dedicated to this. Beyond such, a densification during the heat treatment, it is difficult or even impossible to avoid the detrimental effects of PPBs and of the decorations to the PPBs. A densification above about 15%, therefore does not allow the aforementioned goal of the disclosure to be attained. For this purpose, a pressure of more than 50 bars is generally recommended.

The densification which follows is carried out at a temperature generally identical or comparable with that of the heat treatment for a duration of the order of 4 to 16 hrs, there again notably depending on the dimensions of the container-powder assembly. By modeling the densification and the distribution of temperature in the part during the stage, it is possible to set the duration of the latter depending on the desired temperature homogeneity. The densification of the powder in the container is followed by a heat treatment according to usual methods for attaining the final characteristics of the alloy. When argon is used as an atomization gas, the usual heat treatment after densification is carried out at a temperature which is at least 30° C. less than the densification temperature in order to avoid the occurrence of porosities due to the presence of argon in the mixture.

Hot isostatic compaction is a preferential densification method within the scope of the disclosure but other methods may be contemplated such as hot unidirectional compression or an extrusion.

After densification, the ingot or billet which is the result of this, is conventionally peeled and then hot-shaped. This hot shaping generally notably includes forging. The latter is preferably carried out at a supersolvus temperature, typically for 725® between about 1,010 and 1,030° C., and in one exemplary arrangement, preferably at 1,025° C. This forging may be followed by die stamping in a forging tool (die) in order to give it the desired final geometry. This operation may be performed in one to three steps, according to the dimensions of the targeted final part.

Potting die forging (also called "potting die upsetting"), for example in three steps, is particularly recommended, but not required, for the envisioned preferential applications, since it allows calibration of the half product for the die stamping and kneading of its surface in order to obtain microstructural characteristics thereon which are as close as possible to those which are found in the core of the half product. It is reminded that so-called "potting die forging" is forging during which the billet or the ingot to be forged is placed in an annular part called a "potting die", which during the forging will allow radial constraint of the billet or ingot in order to obtain microstructural homogeneity of the billet or ingot in the radial directions.

The invention claimed is:

1. A method for preparing a part of nickel-based superalloy by powder metallurgy, including the following steps:

elaboration of a nickel-based superalloy with a composition capable of providing hardening by double precipitation of a gamma' phase and of a gamma" or delta phase;

atomization of a melt of said superalloy in order to obtain a powder;

sifting said powder for extracting the particles thereof having a predetermined grain size;

introducing the powder into a container to form a powder and container assembly;

closing and applying a vacuum to the container;

densification of the powder and of the container by pressurizing the powder and container assembly in order to obtain one of an ingot or a billet;

hot forming said ingot or said billet;

wherein before the step for densifying the powder and the container, a heat treatment step is performed for at least 4 hours, at a pressure causing densification of the powder of less than or equal to 15% of the initial volume, this treatment taking place under an inert and non-reactive atmosphere at a temperature both above 1,140° C. and at least 10° C. less than the solidus temperature of the superalloy.

2. The method according to claim 1, wherein the composition of the superalloy is, in weight percentages:

19%≤Cr≤23%;
7%≤Mo≤9.5%;
2.75%≤Nb≤4%;
traces≤Fe≤9%;
traces≤Al≤0.6%;
1%≤Ti≤1.8%;
0.001%≤B≤0.005%
traces≤Mn≤0.35%;
traces≤Si≤0.2%;
traces≤C≤0.03%;
traces≤Mg≤0.05%;
traces≤P≤0.015%;
traces≤S≤0.01%;
the remainder being nickel and impurities resulting from the elaboration.

3. The method according to claim 1 wherein the heat treatment before densification is carried out at a temperature 10 to 50° C. less than the solidus temperature of the superalloy.

4. The method according to claim 3, wherein the heat treatment before densification is carried out at a temperature both above 1,140° C. and 30 to 50° C. less than the solidus temperature of the superalloy.

5. The method according to claim 4, wherein the heat treatment before densification is carried out between 1,160 and 1,180° C. for 12 hours to 30 hours at a pressure of less than or equal to 50 bars.

6. The method according to claim 5, wherein the heat treatment before densification is carried out at atmospheric pressure.

7. The method according to claim 1, wherein the densification is carried out by hot isostatic compaction.

8. The method according to claim 1, wherein the hot forming includes potting die forging.

9. The method according to claim 1, wherein the step of introducing the powder into a container is performed under vacuum.

10. The method according to claim 1, further comprising heat treating the ingot or billet after the densification step.

11. The method according to claim 1, wherein the heat treatment step performed before the densification step is performed for 12 to 30 hours.

12. The method according to claim 1, wherein the heat treatment step performed before the densification step is performed at a pressure causing densification of the powder of less than or equal to 10% of the initial volume.

* * * * *